US005621923A

United States Patent [19]

Tapocik

[11] Patent Number: 5,621,923

[45] Date of Patent: Apr. 22, 1997

[54] INTERFACE APPARATUS FOR ADAPTING A VISOR AND A CHIN PROTECTOR TO STANDARD BICYCLE HELMENTS AND THE LIKE

[76] Inventor: Bryan J. Tapocik, 2941 McAllister St., Riverside, Calif. 92503

[21] Appl. No.: 594,682

[22] Filed: Feb. 2, 1996

[51] Int. Cl.[6] ..... A42B 3/00

[52] U.S. Cl. ..... 2/422; 2/12; 2/425

[58] Field of Search ..... 2/6.2, 8, 9, 10, 2/12, 15, 410, 411, 421, 422, 423, 424, 425

[56] References Cited

U.S. PATENT DOCUMENTS

| | | | |
|---|---|---|---|
| 2,817,087 | 12/1957 | Rush | 2/8 |
| 3,137,005 | 6/1964 | Herbine et al. | 2/8 |
| 3,293,660 | 12/1966 | Macklin | 2/9 |
| 3,409,908 | 11/1968 | Simpson et al. | 2/424 |
| 3,430,261 | 3/1969 | Benner | 2/8 |
| 3,430,262 | 3/1969 | Raschke | 2/8 |
| 3,436,760 | 4/1969 | Molitoris | 2/422 |
| 3,551,910 | 1/1971 | Raschke | 2/424 |
| 3,732,574 | 5/1973 | Hale | 2/9 |
| 4,224,694 | 9/1980 | Palmaer | 2/8 |
| 4,536,892 | 8/1985 | Brinkhoff et al. | 2/424 |
| 5,351,339 | 10/1994 | Reuber et al. | 2/424 |
| 5,517,698 | 5/1996 | Nault et al. | 2/424 |

FOREIGN PATENT DOCUMENTS

| | | | |
|---|---|---|---|
| 553037 | 7/1993 | European Pat. Off. | 2/422 |

*Primary Examiner*—Michael A. Neas

*Attorney, Agent, or Firm*—Thomas I. Rozsa; Tony D. Chen

[57] ABSTRACT

An interface apparatus for adapting separate bicycle accessories such as a visor, a chin protector or both to standard bicycle helmets. The interface apparatus comprises rear locking fasteners so that the interface apparatus can be locked in position surrounding: the perimeter of the standard bicycle helmet and before it is attached thereto.

22 Claims, 3 Drawing Sheets

INTERFACE APPARATUS FOR ADAPTING A VISOR AND A CHIN PROTECTOR TO STANDARD BICYCLE HELMENTS AND THE LIKE

BACKGROUND OF THE INVENTION

1. Field of the Invention

The present invention relates to the field of bike accessories. More particularly, the present invention relates to an interface apparatus for adapting bicycle accessories to standard bicycle helmets and the like.

2. Description of the Prior Art

Generally, standard bicycle helmets have long been known in the bicycle industry for protection of the head of a rider from injury. One of the problems with standard bicycle helmets is that prior art helmets do not have means for an individual to attach separate bicycle accessories to the helmets, such as a visor, a chin protector or both.

Therefore, it is highly desirable to have a very efficient and also very effective design and construction of an interface apparatus for attaching a visor and a chin protector to a standard bicycle helmet, thereby providing a full face helmet for protecting the face of a rider. It is also desirable to provide an interface apparatus with the capability of rapidly attaching and detaching the visor and the chin protector to and from the helmet.

SUMMARY OF THE INVENTION

The present invention is a unique interface apparatus for adapting bicycle accessories such as a visor, a chin protector or both to standard bicycle helmets.

It has been discovered, according to the present invention, that by providing an interface apparatus, then separate bicycle accessories such as a visor, a chin protector or both can be adapted to a standard bicycle helmet.

It has further been discovered, according to the present invention, that by providing an interface apparatus with a rear locking fastening means, then the interface apparatus can be quickly locked in position surrounding the perimeter of the standard bicycle helmet before the interface apparatus is attached thereto.

It is therefore an object of the present invention to provide an interface apparatus for adapting separate bicycle accessories such as a visor, a chin protector or both to a standard bicycle helmet.

It is an additional object of the present invention to provide an interface apparatus with indentions so that the indentions assist in securing the interface apparatus to the standard bicycle helmet.

It is a further object of the present invention to provide an interface apparatus with a rear locking fastening means, so that the interface apparatus can be quickly locked in position surrounding the perimeter of the standard bicycle helmet and before the interface apparatus is attached thereto.

It is also object of the present invention to provide an interface apparatus with an adjustable opening at the front of the interface apparatus so that when the visor is attached to the interface apparatus, it can be adjusted in the vertical direction by loosening a screw.

In the preferred embodiment of the present invention, the interface apparatus is adapted for attaching separate bicycle accessories such as a visor, a chin protector or both to standard bicycle helmets and the like.

In an alternative embodiment of the present invention, the chin protector is integrally formed with the interface apparatus.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
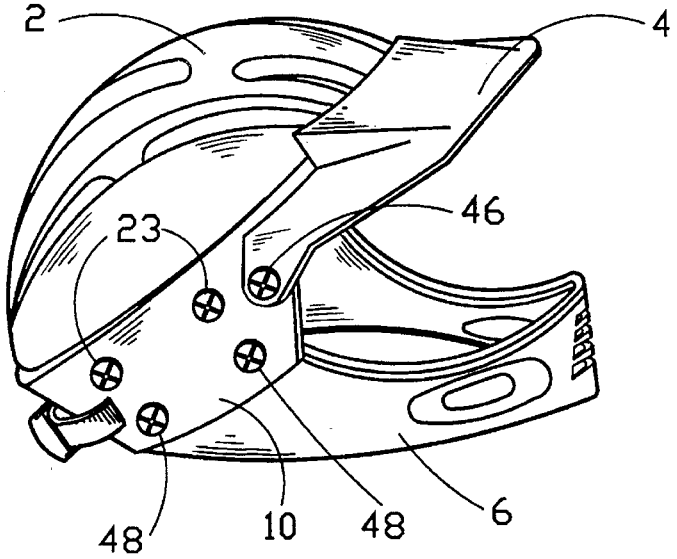
FIG. 1 is a perspective view of the preferred embodiment of the present invention interface apparatus for adapting a visor and a chin protector to a standard bicycle helmet.

Described briefly, the present invention deals with standard bicycle helmets or the like. Referring to FIG. 1, there is depicted a typical standard bicycle helmet 2, wherein the present invention interface apparatus 10 is attached thereto, so that bicycle accessories such as a visor 4, a chin protector 6 or both can be adapted to the bicycle helmet 2, thereby forming a full face helmet. The present invention interface apparatus may be permanently attached to or detachable from all standard bicycle helmets and the like.

Figure 2:
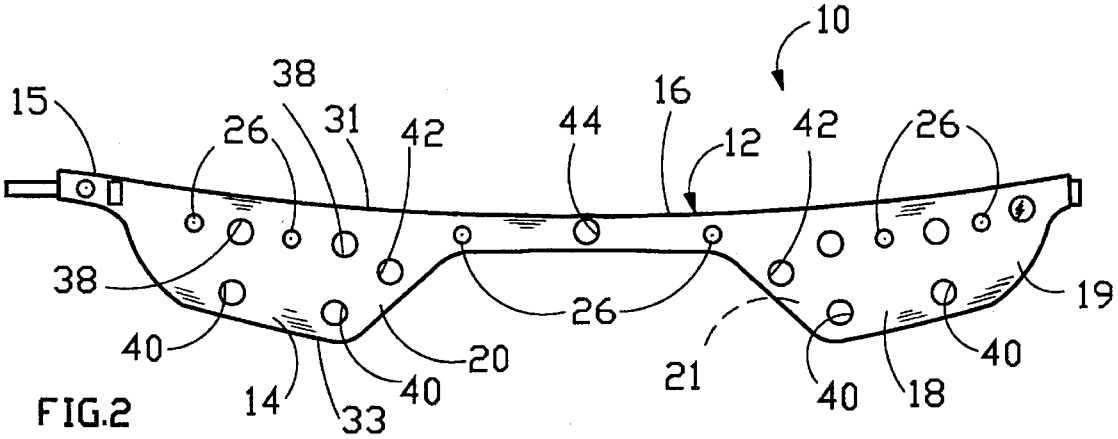
FIG. 2 is a side elevational view of the present invention interface apparatus in its detached condition.

Referring to FIG. 2, there is shown at 10 a side elevational view of the present invention interface apparatus which is generally an elongated sheet of flexible plastic material 12. From left to right of FIG. 2, the sheet 12 comprises a left section 14 with a left end 15, a middle section 16 and a right section 18 with a right end 19. The sheet 12 further has an interior surface 20, an exterior surface 21, an upper perimeter 31 and a lower perimeter 33.

Figure 3:
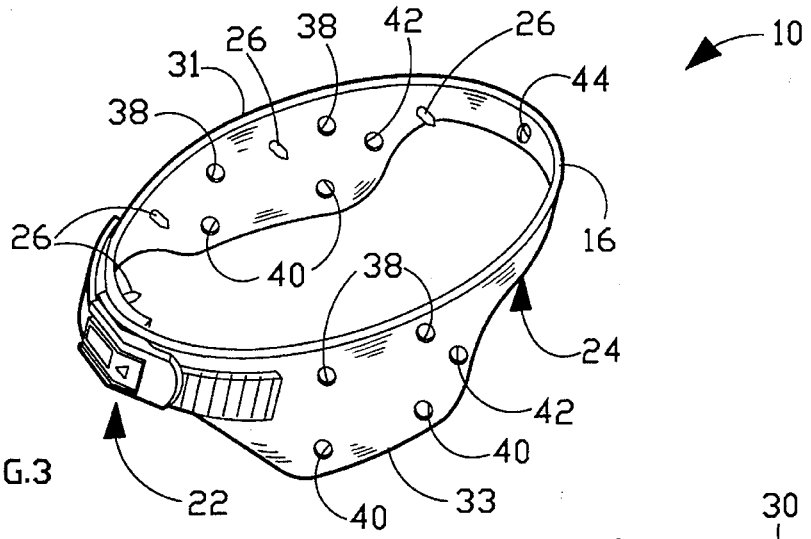
FIG. 3 is a perspective view of the present invention interface apparatus in its closed condition.
Figure 8:
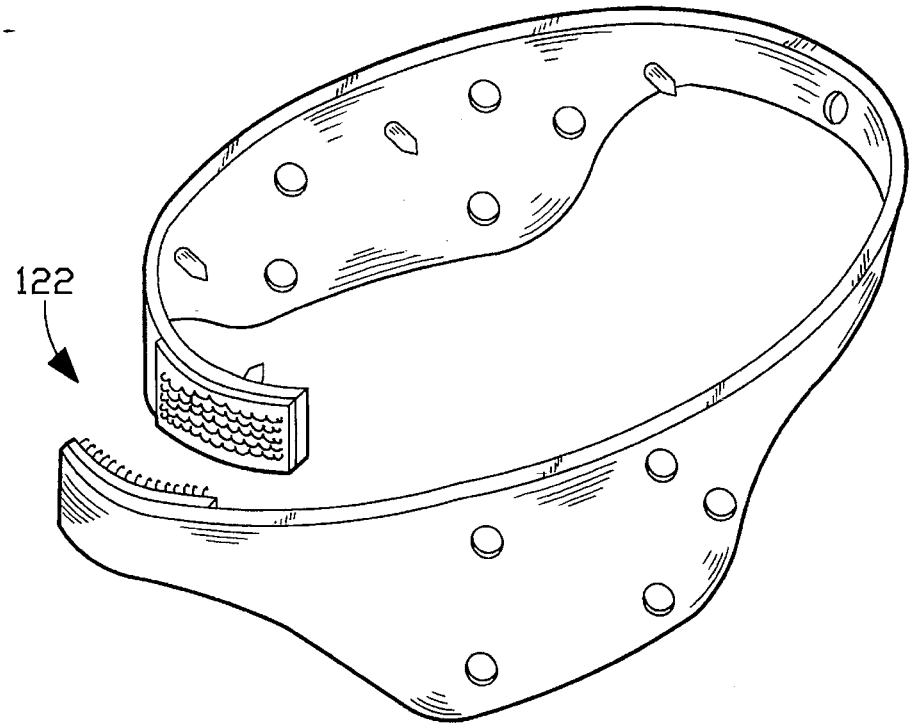
FIG. 8 is a perspective view of another embodiment of the rear locking device, showing a male fastener with a hook type surface and a complementary female fastener with a loop type surface.
Figure 9:
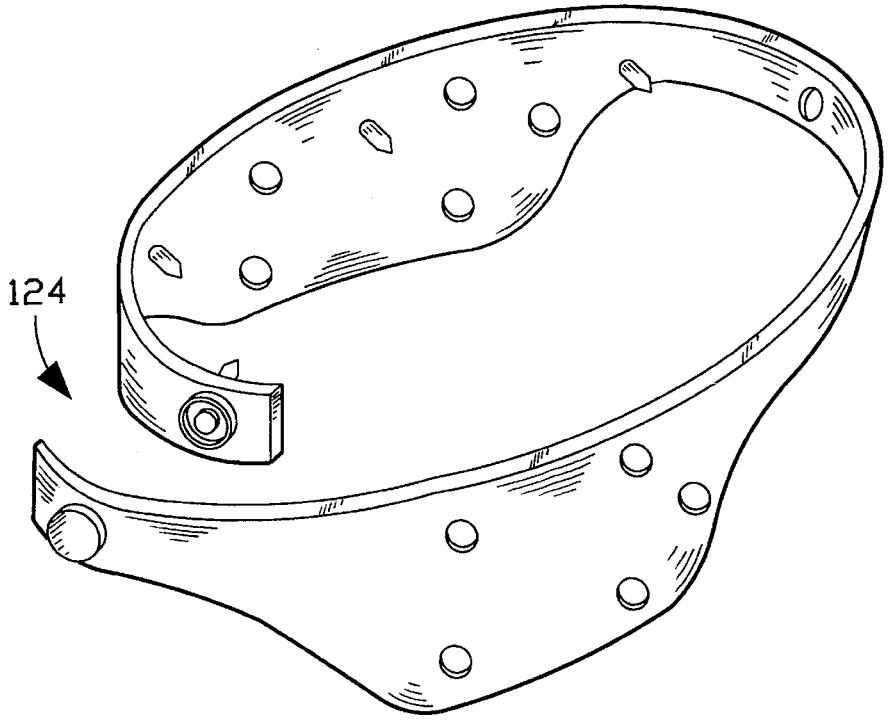
FIG. 9 is a perspective view of still another embodiment of the rear locking device, showing a male snap fastener and a complementary female snap fastener.

Referring to FIG. 3, there is shown at 10 a perspective view of the present invention interface apparatus in its closed status. A rear locking device 22 is respectively attached to the opposite ends 15 and 19 of the sheet 12 for adjustably fastening the ends 15 and 19 together to form an ovoid shaped structure 24 which surrounds the perimeter of the standard bicycle helmet 2 (see FIG. 1). The rear locking device 22 is similar to a ski boot type adjusting buckle. It will be appreciated that any suitable fastener means may be employed, for example, VELCRO® fasteners 122 (see FIG. 8), snap fasteners 124 (see FIG. 9) or a ziptie type system.

Referring to FIGS. 1, 2 and 3, there is shown a multiplicity of slight protruding indentions 26 which are provided on the interior surface 20 of the sheet 12 and located on the left and right sections 14 and 18 respectively to assist in securing the interface apparatus 10 to the standard bicycle helmet 2. Once the ovoid shaped structure 24 is formed around the helmet 2 and held in position by the rear locking device 22, the protruding indentions 26 will puncture into and secure the ovoid shaped structure 24 on the foam of the helmet 2, thereby providing a more stable interface apparatus 10 to the helmet 2. The interface apparatus 10 is attached to the helmet 2 by screw means 23 or other suitable means. The left and right sections 14 and 18 of the sheet 12 are each provided with two upper apertures 38, two lower apertures 40, and a middle aperture 42 located between the upper and lower apertures 38 and 40, and adjacent to the middle section 16. The upper apertures 38 which are located adjacent to the upper perimeter 31 are utilized for attaching the interface apparatus 10 to the helmet 2, and the lower apertures 40 which are located adjacent to the lower perimeter 33 are utilized for attaching the chin protector 6 to-the interface apparatus 10. The middle apertures 42 are utilized for attaching the visor 4 to the interface apparatus 10. There is also another aperture 44 located on the middle section 16 for adjustably attaching the visor 28 to the, ovoid shaped structure 24.

Figure 4:
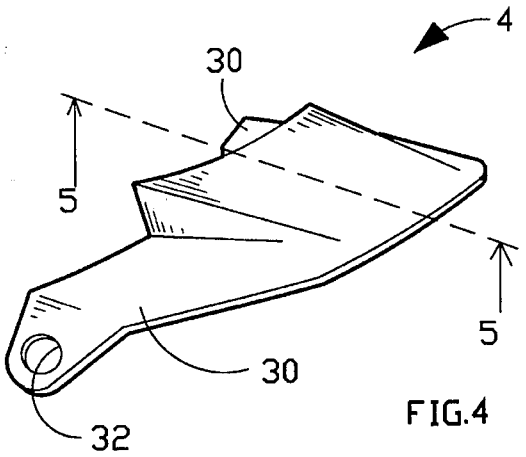
FIG. 4 is a perspective view of the visor used in conjunction with the present invention interface apparatus.
Figure 5:
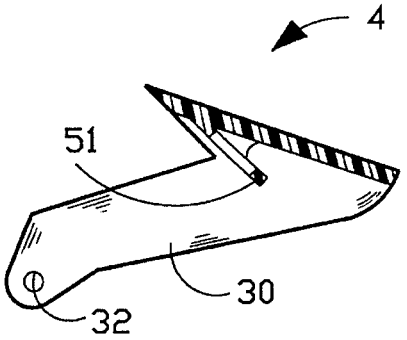
FIG. 5 is a cross-sectional view taking along line 5—5 of FIG. 4.

Referring to FIGS. 1, 4 and 5, there is shown at 4 the typical visor used in the bicycle industry. The visor 4 has opposite wing-tips 30, each having an aperture 32 (only one is shown). The visor 4 is attached to the interface apparatus 20 by screws 46 (only one is shown). The visor 4 has a vertical slot 51 for adjusting a vertical height of the visor.

Figure 6:
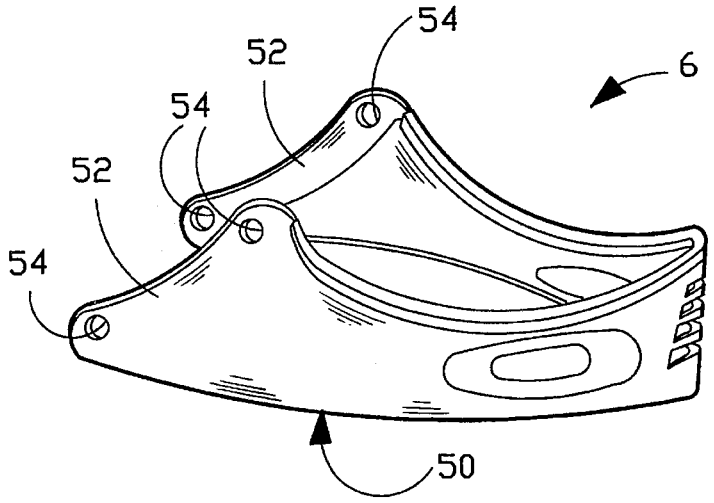
FIG. 6 is a perspective view of the chin protector used in conjunction of the present invention interface apparatus.

Referring to FIGS. 1 and 6, there is shown at 6 a perspective view of the chin protector. The chin protector 6 has a generally U-shaped structure 50 having two opposite ends 52. Each end of the U-shaped structure 50 has two apertures 54 which are aligned with the lower apertures 40 of the interface apparatus 10 for securing the chin protector 34 thereto by screws 48 (only two screws are shown on one side).

When the interface apparatus 10 is attached around the perimeter of the helmet 2, the interface apparatus thereby substantially adapts the visor 4 and the chin protector 6 to the helmet 2, as shown in FIG. 1.

The present invention conforms to conventional forms of manufacture. The sheet 12 of the present invention can be made from several materials. The manufacturing process which could accommodate the construction of the sheet 12 may be injection, thermoform, etc., or other molding process. By way of example, the sheet can be made of plastic material or any other suitable material.

Figure 7:
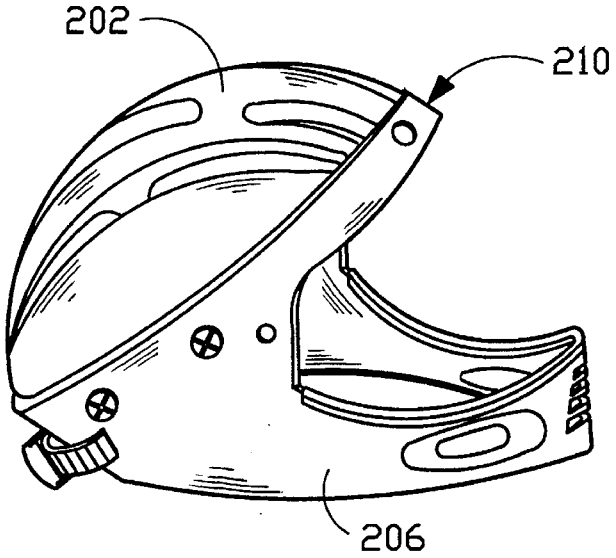
FIG. 7 is a perspective view of an alternative embodiment of the present invention, showing a unitary interface apparatus with an integrally formed chin protector.

Referring to FIG. 7, there is shown at 210 a perspective view of an alternative embodiment of the present invention interface apparatus 210 attached to a standard bicycle helmet 202. In this embodiment, the present invention is very similar to the preferred embodiment just discussed and the only difference is that the chin protector 206 is integrally formed with the interface apparatus 210. Everything else is the same, and the description thereof will not be repeated.

Defined in detail, the present invention is an interface apparatus attachable to a standard protective helmet for attaching a visor and a chin protector thereto, the interface apparatus comprising: (a) an elongated sheet of flexible material having an interior surface, an exterior surface and two opposite ends; (b) fastener means respectively attached to said two opposite ends of said sheet for adjustably fastening said two opposite ends of said sheet to form an ovoid shaped structure around the perimeter of said helmet; (c) means for detachably attaching said ovoid shaped structure to said perimeter of said helmet; (d) means for detachably attaching said chin protector to a lower side section of said ovoid shaped structure; and (e) means for detachably attaching said visor to a front end of said ovoid shaped structure; (f) whereby when said interface apparatus is attached around the perimeter of said helmet, said interface apparatus thereby substantially adapts said visor and said chin protector to said helmet.

Defined broadly, the present invention is an interface apparatus attachable to a protective helmet for adapting a visor and a chin protector to the helmet, the interface apparatus comprising: (a) a sheet of flexible material having two ends; (b) means for adjustably fastening said two ends of said sheet to form an ovoid shaped structure around the perimeter of said helmet; (c) means for detachably attaching said ovoid shaped structure to said perimeter of said helmet; (d) means for detachably attaching said visor to said ovoid shaped structure; and (e) means for detachably attaching said chin protector to said ovoid shaped structure; (f) whereby when said interface apparatus is attached around the perimeter of said helmet, said interface apparatus thereby substantially adapts said visor and said chin protector to said helmet.

Defined more broadly, the present invention is an interface apparatus attachable to a helmet for adapting at least one bicycle accessory to the helmet, the interface apparatus comprising: (a) a sheet of flexible material; (b) means for adjustably fastening said sheet to form a body around the perimeter of said helmet; (c) means for detachably attaching said body to said perimeter of said helmet; and (d) means for detachably attaching said at least one bicycle accessory to said body; (e) whereby when said interface apparatus is attached around the perimeter of said helmet, said interface apparatus thereby substantially adapts said at least one bicycle accessory to said helmet.

Defined alternatively broadly, the present invention is an interface apparatus attachable to a protective helmet for adapting at least one bicycle accessory to the helmet, the interface apparatus comprising: (a) a sheet of flexible material; (b) a chin protector integrally formed with said sheet; (c) means for adjustably fastening said sheet to the perimeter of said helmet; (d) means for detachably attaching said sheet to the perimeter of said helmet; and (e) means for detachably attaching said at least one bicycle accessory to said sheet; (f) whereby when said interface apparatus is attached around the perimeter of said helmet, said interface apparatus thereby substantially adapts said at least one bicycle accessory to said helmet.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An interface apparatus attachable to a standard protective helmet for attaching a visor and a chin protector thereto, the interface apparatus comprising:

a. an elongated sheet of flexible material having an interior surface, an exterior surface and two opposite ends;

b. fastener means respectively attached to said two opposite ends of said sheet for adjustably fastening said two opposite ends of said sheet to form an ovoid shaped structure around the perimeter of said helmet;

c. means for detachably attaching said ovoid shaped structure to said perimeter of said helmet;

d. means for detachably attaching said chin protector to a lower side section of said ovoid shaped structure; and e. means for detachably attaching said visor to a front end of said ovoid shaped structure;

f. whereby when said interface apparatus is attached around the perimeter of said helmet, Said interface apparatus thereby substantially adapts said visor and said chin protector to said helmet.

2. The interface apparatus in accordance with claim 1 further comprising means for adjustably adjusting said visor to a vertical height.

3. The interface apparatus in accordance with claim 2 wherein said means for adjustably adjusting said visor to said vertical height comprises a vertical slot on said visor.

4. The interface apparatus in accordance with claim 1 further comprising a multiplicity of protruding indentions located on said interior surface of said sheet for assisting in securing said ovoid shaped structure to the perimeter of said helmet.

5. The interface apparatus in accordance with claim 1 wherein said fastener means includes a buckle.

6. The interface apparatus in accordance with claim 1 wherein said fastener means comprises a male fastener with a hook type surface and a complementary female fastener with a loop type surface.

7. The interface apparatus in accordance with claim 1 wherein said fastener means comprises a male snap fastener and a complementary female snap fastener.

8. An interface apparatus attachable to a protective helmet for adapting a visor and a chin protector to the helmet, the interface apparatus comprising:

a. a sheet of flexible material having two ends;

b. means for adjustably fastening said two ends of said sheet to form an ovoid shaped structure around the perimeter of said helmet;

c. means for detachably attaching said ovoid shaped structure to said perimeter of said helmet;

d. means for detachably attaching said visor to said ovoid shaped structure; and e. means for detachably attaching said chin protector to said ovoid shaped structure;

f. whereby when said interface apparatus is attached around the perimeter of said helmet, said interface apparatus thereby substantially adapts said visor and said chin protector to said helmet.

9. The interface apparatus in accordance with claim 8 further comprising means for adjustably adjusting said visor to a vertical height.

10. The interface apparatus in accordance with claim 9 wherein said means for adjustably adjusting said visor to said vertical height comprises a vertical slot on said visor.

11. The interface apparatus in accordance with claim 8 further comprising protruding indentions located on said sheet for assisting in securing said ovoid shaped structure to the perimeter of said helmet.

12. The interface apparatus in accordance with claim 8 wherein said means for adjustably fastening said two ends of said sheet to form said ovoid shaped structure around the perimeter of said helmet includes a buckle.

13. The interface apparatus in accordance with claim 8 wherein said means for adjustably fastening said two ends of said sheet to form said ovoid shaped structure around the perimeter of said helmet comprises a male fastener with a hook type surface and a complementary female fastener with a loop type surface.

14. The interface apparatus in accordance with claim 8 wherein said means for adjustably fastening said two ends of said sheet to form said ovoid shaped structure around the perimeter of said helmet comprises a male snap fastener and a complementary female snap fastener.

15. An interface apparatus attachable to a helmet for adapting at least one bicycle accessory to the helmet, the interface apparatus comprising:

a. a sheet of flexible material;

b. means for adjustably fastening said sheet to form a body around the perimeter of said helmet;

c. means for detachably attaching said body to said perimeter of said helmet;

d. means for detachably attaching said at least one bicycle accessory to said body; and e. at least two protruding indentions located on said sheet for assisting in securing said body to the perimeter of said helmet;

f. whereby when said interface apparatus is attached around the perimeter of said helmet, said interface apparatus thereby substantially adapts said at least one bicycle accessory to said helmet.

16. The interface apparatus in accordance with claim 15 wherein said means for adjustably fastening said sheet to form said body around the perimeter of said helmet includes a buckle.

17. The interface apparatus in accordance with claim 15 wherein said at least one bicycle accessory includes a visor.

18. The interface apparatus in accordance with claim 15 wherein said at least one bicycle accessory includes a chin protector.

19. An interface apparatus attachable to a protective helmet for adapting at least one bicycle accessory to the helmet, the interface apparatus comprising:

a. a sheet of flexible material;

b. a chin protector integrally formed with said sheet;

c. means for adjustably fastening said sheet to the perimeter of said helmet;

d. means for detachably attaching said sheet to the perimeter of said helmet; and e. means for detachably attaching said at least one bicycle accessory to said sheet;

f. whereby when said interface apparatus is attached around the perimeter of said helmet, said interface apparatus thereby substantially adapts said at least one bicycle accessory to said helmet.

20. The interface apparatus in accordance with claim 19 further comprising protruding indentions located on said sheet for assisting in securing said sheet to the perimeter of said helmet.

21. The interface apparatus in accordance with claim 19 wherein said means for adjustably fastening said sheet to the perimeter of said helmet includes a buckle.

22. The interface apparatus in accordance with claim 19 wherein said at least one bicycle accessory includes a visor.

* * * * *